US009917404B1

(12) United States Patent
Kuo et al.

(10) Patent No.: US 9,917,404 B1
(45) Date of Patent: Mar. 13, 2018

(54) CONNECTOR COVERS AND SYSTEMS TO PREVENT MISCONNECTIONS

(71) Applicant: Balboa Water Group, Inc., Tustin, CA (US)

(72) Inventors: Steven Kuo, Chino Hills, CA (US); Charles Joseph Heiden, Mission Viejo, CA (US)

(73) Assignee: Balboa Water Group, Inc., Tustin, CA (US)

( * ) Notice: Subject to any disclaimer, the term of this patent is extended or adjusted under 35 U.S.C. 154(b) by 0 days.

(21) Appl. No.: 15/606,507

(22) Filed: May 26, 2017

(51) Int. Cl.
*H01R 13/64* (2006.01)
*H01R 13/645* (2006.01)
*H01R 13/627* (2006.01)
*H01R 13/506* (2006.01)

(52) U.S. Cl.
CPC ..... *H01R 13/645* (2013.01); *H01R 13/506* (2013.01); *H01R 13/6272* (2013.01)

(58) Field of Classification Search
CPC .. H01R 13/645; H01R 13/64; H01R 13/5219; H01R 13/6471; H01R 13/506; H01R 13/6272; H01R 12/7005
USPC ..... 439/680
See application file for complete search history.

(56) References Cited

U.S. PATENT DOCUMENTS 4,772,210 A * 9/1988 Venaleck ..... H01R 12/7005 439/357
5,674,094 A * 10/1997 Hutchinson, Jr. ..... H01R 13/64 439/680
7,744,385 B2 * 6/2010 Scherer ..... H01R 13/6471 439/101
2007/0072461 A1 * 3/2007 Williams ..... H01R 13/5219 439/144

* cited by examiner

*Primary Examiner* — Jean F Duverne
(74) *Attorney, Agent, or Firm* — Larry K. Roberts

(57) ABSTRACT

Embodiments of a connector cover are described, which are easily attached to a keyed electrical connector housing, and which prevent misconnection with a mating connector. One embodiment features a snap-on design, in which the cover simply snaps onto the keyed connector housing. A second embodiment is in the form of a two-piece cover, which snap together about the keyed connector housing. A third exemplary embodiment features a slip-on design, in which the cover slips onto the keyed connector housing. In another aspect, an electrical connector system is described, which includes the connector cover and first and second keyed electrical connectors.

14 Claims, 10 Drawing Sheets

FIG. 11A
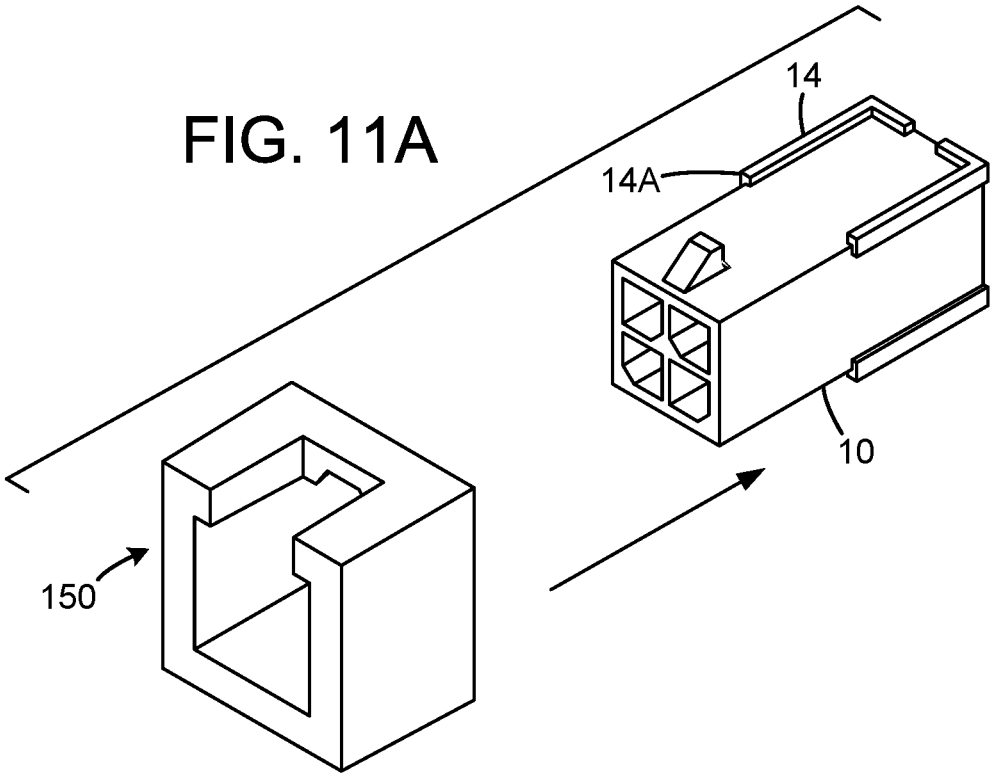
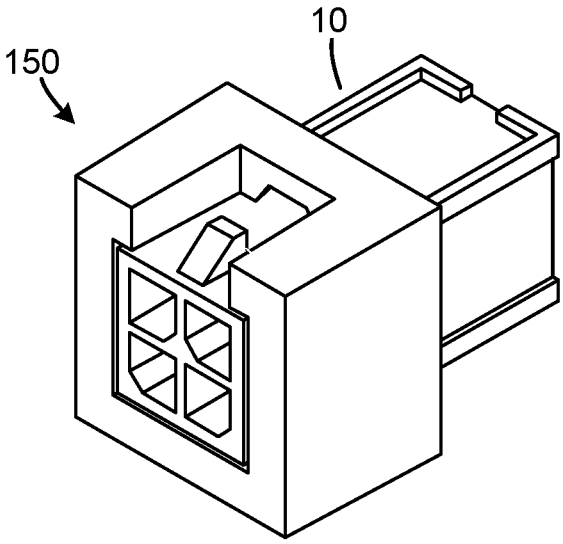
FIG. 11B

CONNECTOR COVERS AND SYSTEMS TO PREVENT MISCONNECTIONS

BACKGROUND

Connector types such as MOLEX® connectors provide a two-piece pin and socket interconnection. In such a connector, cylindrical spring-metal pins fit into cylindrical spring-metal sockets. The pins and sockets are held in a rectangular matrix in a nylon shell. The connector typically has two to 24 contacts and is polarized or keyed to ensure correct orientation. Pins and sockets can be arranged in any combination in a single housing, and each housing can be either male or female. For some connector applications, these connectors may be used for providing power to electrical components.

Even though these connector types are typically polarized or keyed, it is still possible to force the male/female connectors together in an incorrect orientation. When this happens, typically in a fielded device undergoing installation or repair, the electrical components may be damaged due to incorrect currents or voltages being applied to the devices or components wired to the connectors.

BRIEF DESCRIPTION OF THE DRAWINGS

Features and advantages of the disclosure will readily be appreciated by persons skilled in the art from the following detailed description when read in conjunction with the drawing wherein:

FIG. 11A is an isometric view showing the cover of FIG. 10A in position to slide onto a keyed connector. FIG. 11B shows the cover in the attached position on the keyed connector.

DETAILED DESCRIPTION

Figure 1D:
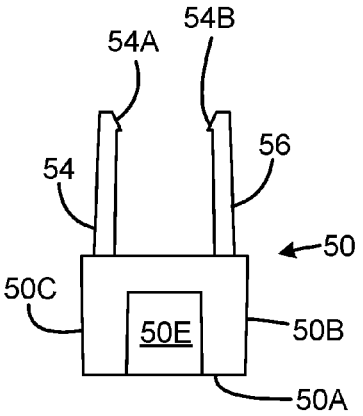
FIGS. 1B-1F are respective front, side, top, bottom and back views of the cover.
Figure 1A:
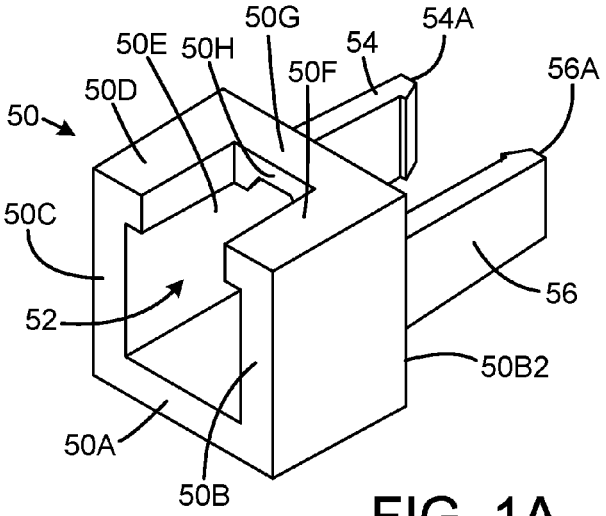
FIG. 1A is an isometric view of an embodiment of a connector cover.

In the following detailed description and in the several figures of the drawing, like elements are identified with like reference numerals.

Embodiments of a connector cover are described, which are easily attached to a keyed electrical connector housing, and which prevent misconnection with a mating connector. One embodiment features a snap-on design, in which the cover simply snaps onto the keyed connector housing. A second embodiment is in the form of a two-piece cover, which snap together about the keyed connector housing. A third exemplary embodiment features a slip-on design, in which the cover slips onto the keyed connector housing. FIGS. 1A-4 illustrate the snap-on cover embodiment. The two-piece cover embodiment is shown in FIGS. 5A-9. The slip-on cover embodiment is illustrated in FIGS. 10A-13.

Referring now to FIGS. 1A-4, a cover 50 is configured to snap onto an electrical connector body generally depicted as connector 10. In this example, the connector 10 is a four pin or socket device having a generally square outer configuration, with four sockets 12 arranged within the outer housing configuration. The cover can also be configured to fit to rectangular connectors, e.g. connectors with two rows and four columns of sockets, or in general any connector housing type. The connector wiring is not shown in the figures for clarity. The connector 10 also has ribs 14 formed at the back end of the connector, which terminate at rib tips 14A intermediate the front and back ends of the connector. These ribs are found on at least some MOLEX® and AMP® connectors; other connector types may have other features which can serve as stop surfaces, if needed. The connector 10 also has a protrusion or key 16 extending above surface 10A, which is intended to engage with a corresponding key structure 26 on the mating connector 20.

Figure 1B:
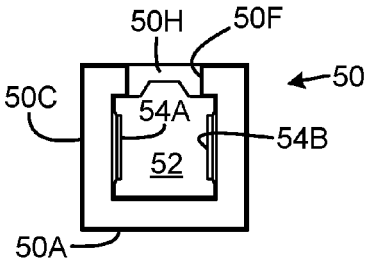
Figure 1C:
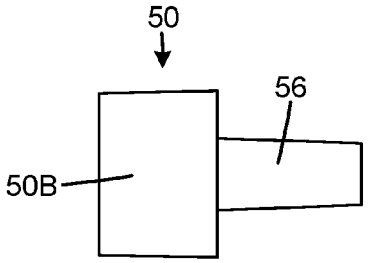
Figure 1E:
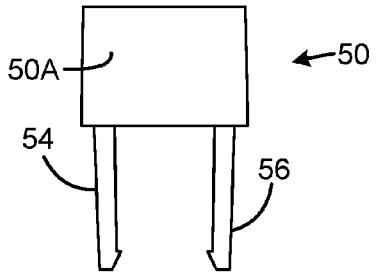
Figure 1F:
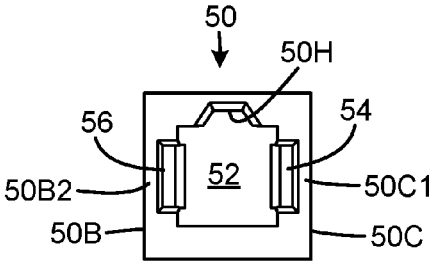

The cover 10 is fabricated of a plastic material such as polyethylene (PE), Polyethylene terephthalate (PET), Polyvinyl chloride (PVC), Acrylonitrile butadiene styrene (ABS), Polypropylene (PP), and Polystyrene (PS), typically by injection molding. Other fabrication methods may also be employed. In this embodiment, the cover defines an aperture 52 which conforms to the outer configuration of the connector 10, in this example a square or rectangular aperture, sufficiently large enough to fit onto the connector 10, snugly enveloping the connector 10 at its front end. The aperture extends through the cover 50, as shown in FIGS. 1B and 1F.

The cover 50 has side arms or clips 54 and 56 extending from the rear surfaces 50B2, 50C1 (FIG. 1F) of side portions 50B and 50C, which terminate in barbed tips 54A, 56A. In this embodiment, the side arms are angled slightly inwardly, as shown in FIGS. 1D, 1E, so that the distance between the barb tips is slightly less than the width dimension of the connector 10.

Figure 2A:
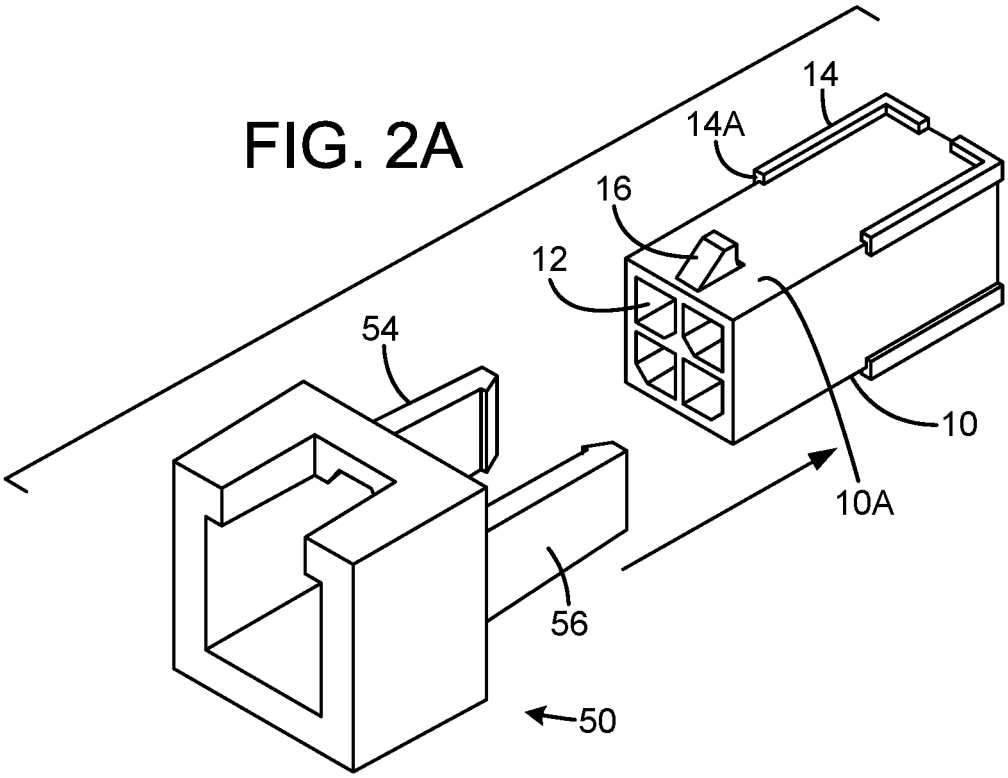
FIG. 2A is an isometric view showing the cover of FIG. 1A in position to slide onto a keyed connector.
Figure 2B:
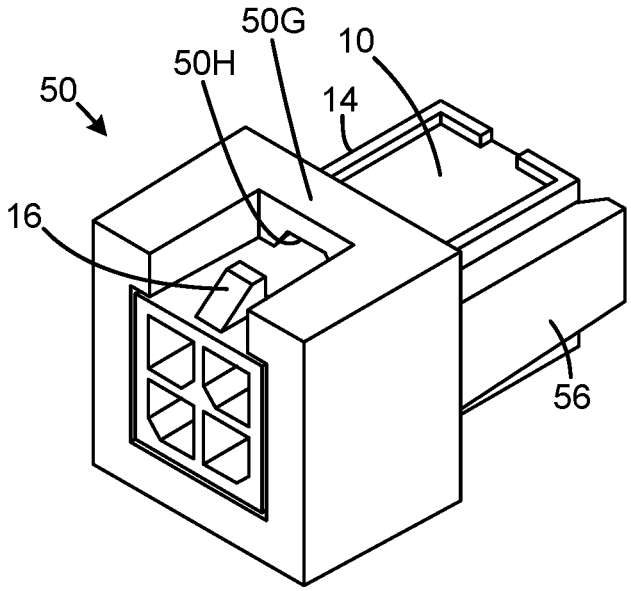
FIG. 2B shows the cover in the attached position on the keyed connector.

The bottom and side wall portions 50A, 50B and 50C are solid surfaces in this example, and form a frame structure around the connector body when installed. The top surface 50D is relieved to form a generally U-shaped relieved area 50E, defined by surface 50F. The closed end of the U is defined by cover portion 50G, in which a notch 50H is formed. The cover portion 50G and notch 50H allow the cover 10 to fitted onto the connector 10, with the protrusion 16 fitting under the portion 50G and through notch 50H, to the attached position, as shown in FIGS. 2A and 2B.

As previously noted, the spacing between the barbs of the side arms 54, 56 is slightly less than the width of the connector body. The side arms are sufficiently flexible to allow the tips of the side arms 54, 56 to flex apart and slide over the sides of the connector 10 until the barbed tips 54A, 56A ride over the back end of the connector, and the back surface of the cover engage the tips 14A of the ribs. The side arm tips flex back to their rest positions, and engage over the back edges of the connector 10, securing the cover in place on the connector 10, as shown in FIG. 2B.

Figure 3:
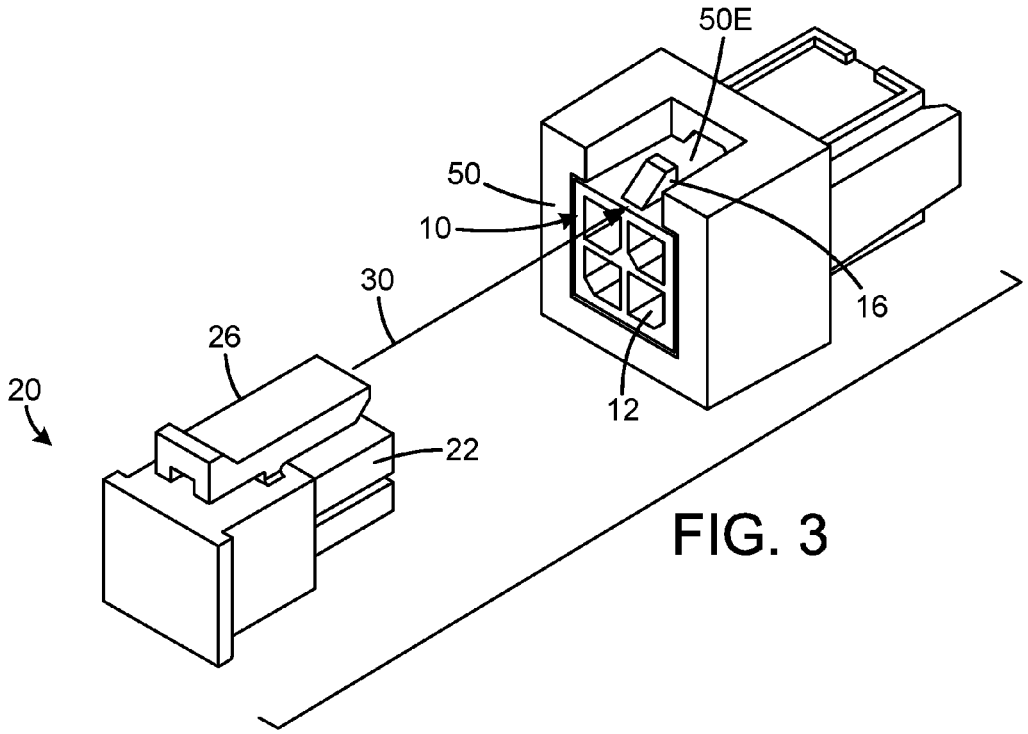
FIG. 3 illustrates the keyed connector with attached cover, and the mating connector in a position ready to be inserted to the keyed connector.
Figure 4:
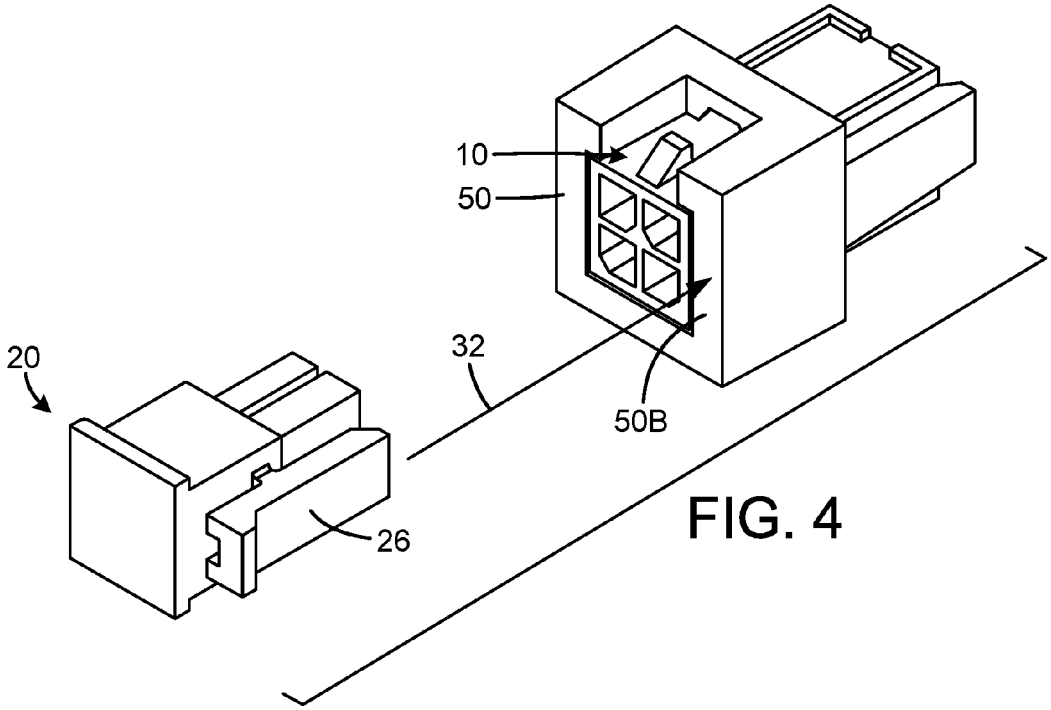
FIG. 4 is a view similar to FIG. 3, but with the mating connector oriented at a 90 degree angle relative to its position in FIG. 3, and illustrating that the cover will prevent connection of the connectors in a misaligned condition.
Figure 5D:
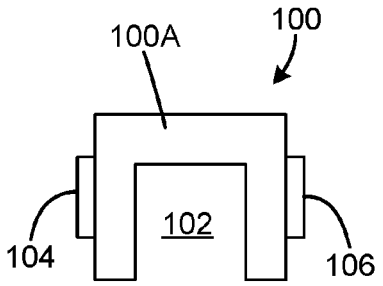
FIGS. 5B-5F are respective front, side, top, bottom and back views of the member of FIG. 5A.
Figure 5A:
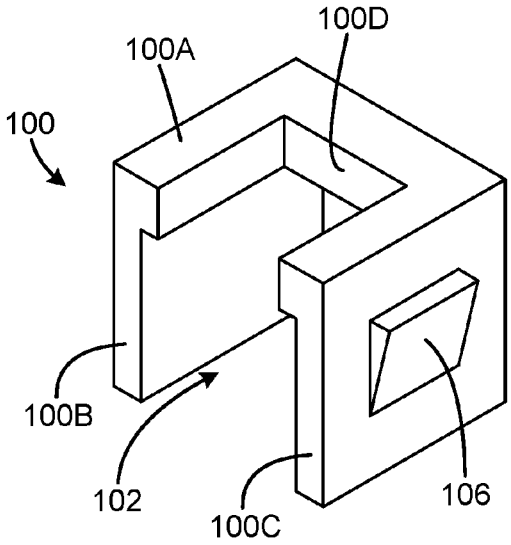
FIG. 5A is an isometric view of one member of an alternate embodiment of a connector cover.
Figure 5B:
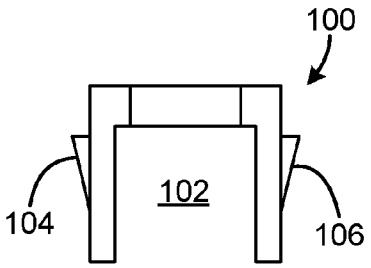
Figure 5C:
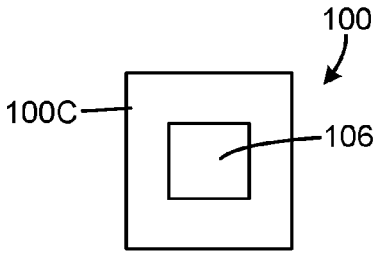
Figure 5E:
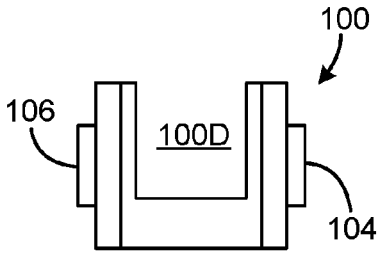
Figure 5F:
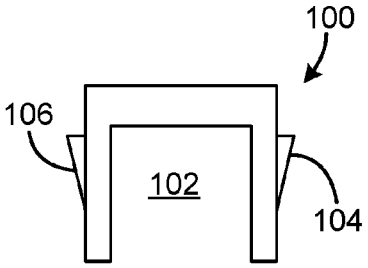

FIG. 3 illustrates the mating connector 20, with its key structure 26, aligned in preparation for movement along arrow direction 30, to engage the connector 10 and its key structure 16. In this the correct orientation of the mating connector to connector 10, the key structure 26 will enter the recess 50E of the cover 20 to engage over the key 16 of the connector 10. The pins 22 of the mating connector fit into the sockets 12 of the connector 10, to make electrical contact between the two connectors. The cover 50 allows mating of the two connectors in the correct orientation (FIG. 3), but the frame structure will physically prevent mating of the connectors in an incorrect orientation. For example, if the mating connector 20 is turned at a 90, 180 or 270-degree orientation from the orientation of FIG. 3, the cover 50 mechanically interferes with the connection, with the key structure 26 contacting the cover 50 to prevent the pins 22 from entering the sockets 12. This interference is illustrated in FIG. 4, in which the mating connector 20 is turned 90 degrees from the FIG. 3 orientation, and with the mating connector 20 and key structure 26 brought toward the connector 10, the key structure 26 is brought to a stop by surface 50B of the cover.

Figure 6A:
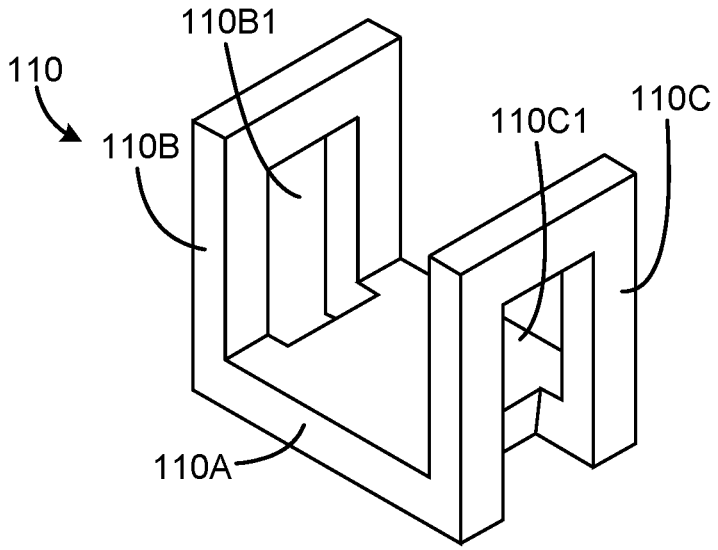
FIG. 6A is an isometric view of the second member of the alternate cover embodiment.
Figure 6D:
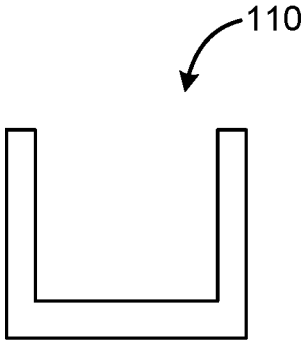
FIGS. 6B-6D are respective bottom, top and front views of the second member.
Figure 6B:
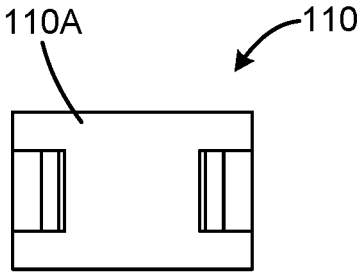
Figure 6C:
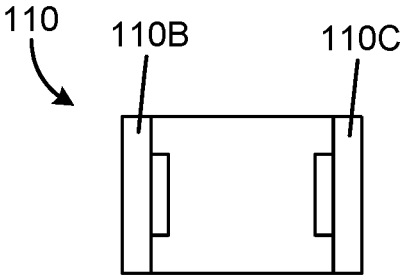
Figure 7B:
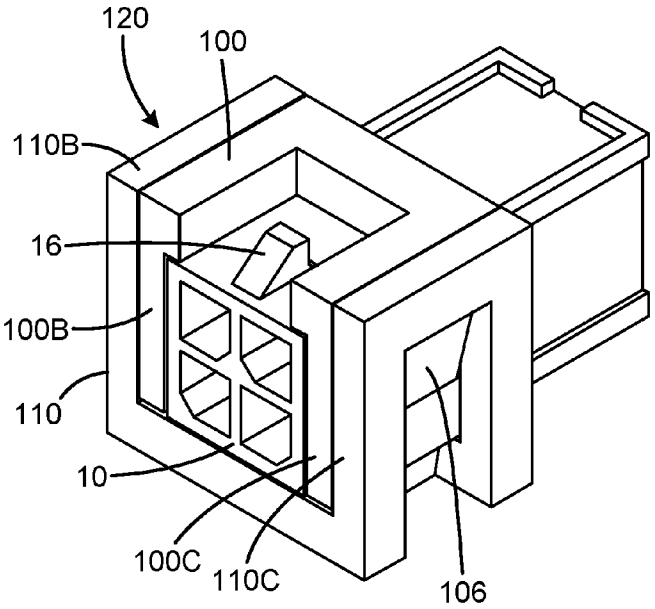
FIG. 7B shows the cover in fully assembled position on the keyed connector.
Figure 7A:
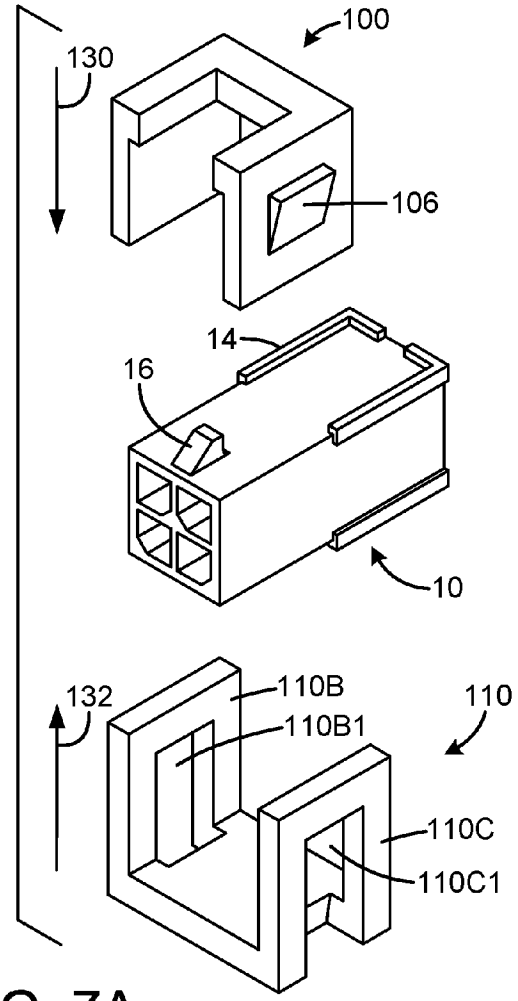
FIG. 7A is an exploded view of the two pieces of the alternate cover, showing how the two members are to be brought together in installed position on the keyed connector.
Figure 8:
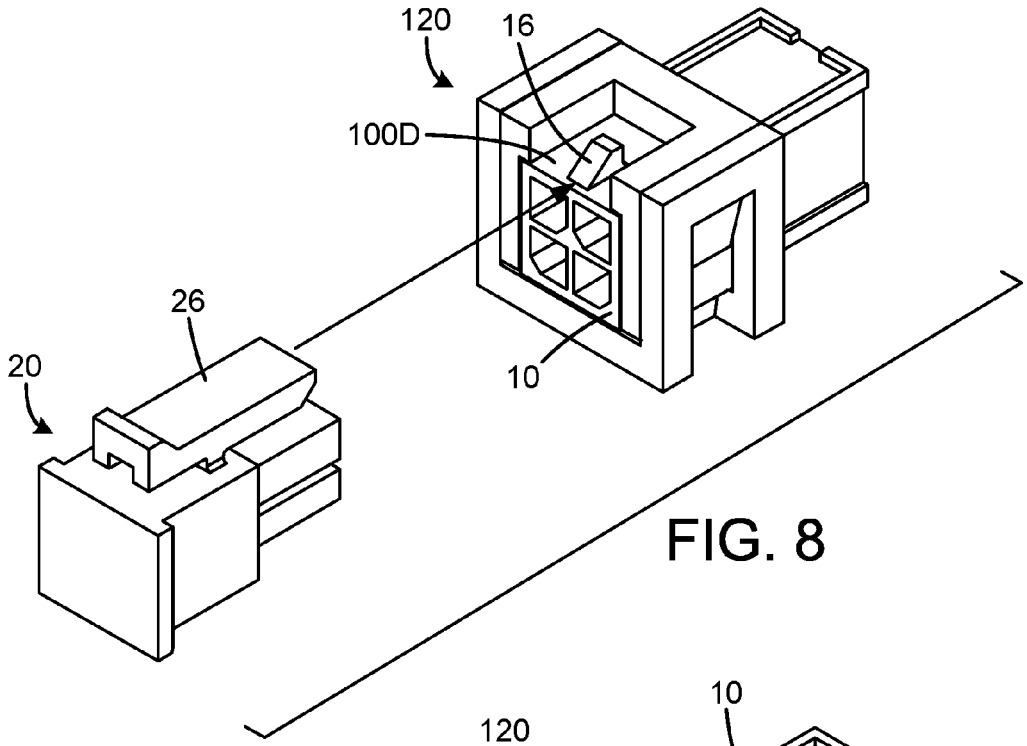
FIG. 8 is an isometric view, showing how the keyed connector with the installed cover of FIGS. 5A-7B permits connection to a mating connector in the keyed orientation.
Figure 9:
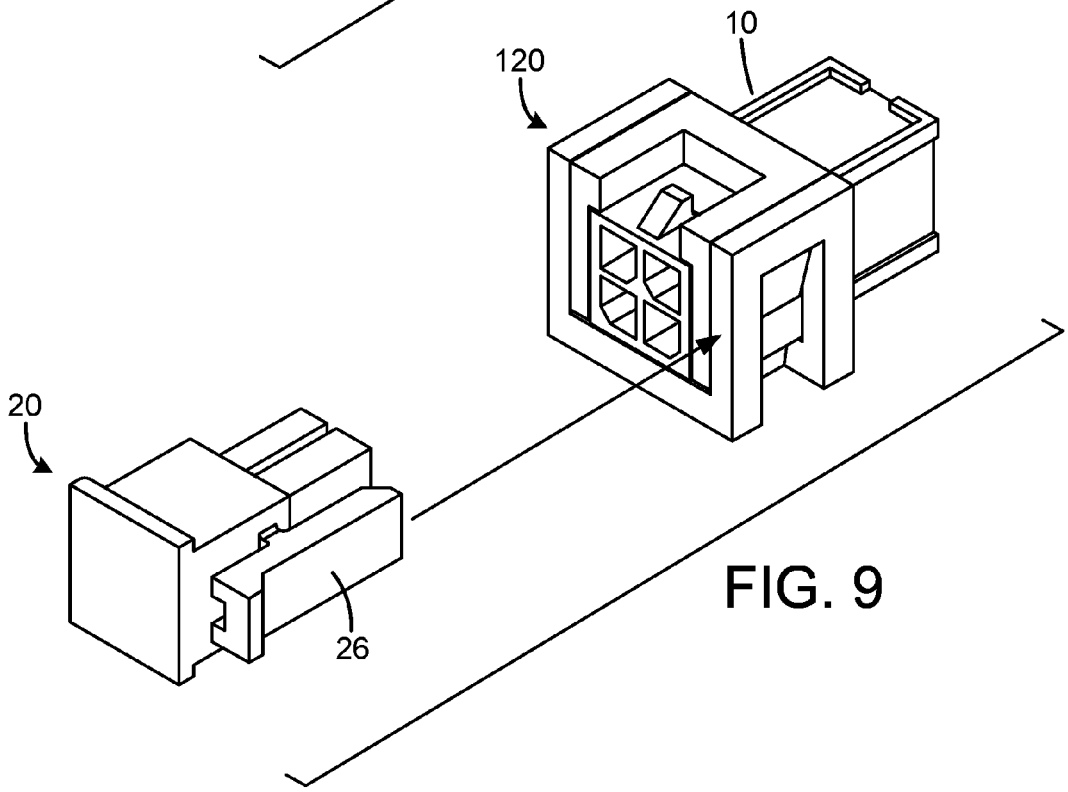
FIG. 9 is a view similar to FIG. 8, but with the mating connector oriented at 90 degrees relative to the FIG. 8 orientation, preventing mating of the two connectors.
Figure 10A:
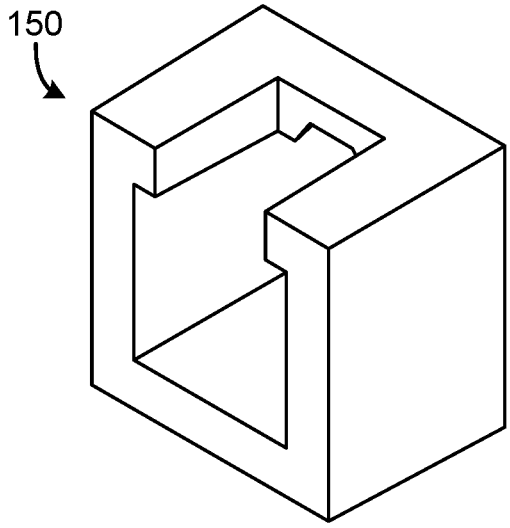
FIG. 10A is an isometric view of a further exemplary embodiment of a connector cover.
Figure 10C:
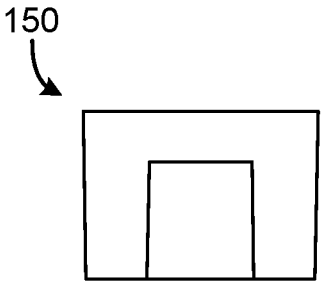
FIGS. 10B-10D are respective front, top and back views of the cover.
Figure 10B:
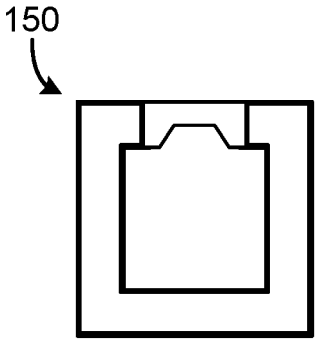
Figure 10D:
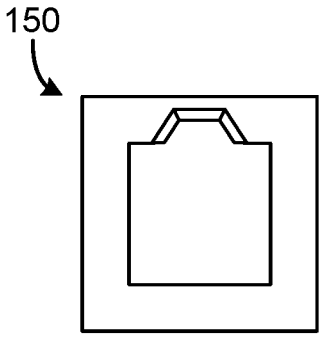

FIGS. 5A-9 illustrate a second embodiment of a cover 120, which is an assembly of two members, 100 and 110. Each member is fabricated of a rigid plastic material as in the embodiment of FIGS. 1-4. The assembled cover 120 provides a structure which fits about the connector 10 to provide mechanical interference preventing mating of the connectors 10 and 20 except along the correct orientation, as shown in FIGS. 8 and 9. This embodiment is intended to snap together in place on the connector, being brought together from above and below the connector as shown in FIG. 7A, not to slide onto the connector in assembled form. As a result, the cover 120 need not include a notch like notch 50H of the cover 50. Alternatively, the cover 120 may include a notch, so that the cover could be assembled first and then slid onto the connector 10, with the notch providing clearance to the key projection 16.

FIGS. 5A-5F illustrate member 100 in isolation, and forms a saddle-like structure, in which left and right side wall portions 100B, 100C are joined by a top wall portion 100A, with a relieved open area 100D formed in the top wall portion. The member 100 has a generally inverted U-shaped configuration with open area 102 formed between the side wall portions and the top wall portion. Wedge-shaped protrusions 104, 106 are formed on the side wall portions 100B, 100C.

FIGS. 6A-6F illustrate the second member 110, which forms a cradle-like structure, configured to attach to the first member 100, so that the assembly forms a structure surrounding the connector 10 at the connection end. The second member includes a bottom surface portion 110A, with side wall portions 110B and 110C extending upwardly from the bottom surface portion, forming a generally U-shaped structure (FIG. 6D). Openings 110B1 and 110C1 are formed in the side wall portions, to also include relieved areas in the bottom surface portion.

The side wall portions 110B, 110C are spaced apart by a slightly larger distance than the distance between the outer planar surfaces of side wall portions 100B, 100C of member 100, to allow the side wall portions of the member 100 to fit between the side wall portions 110B, 110C.

Both members 100, 110 may be fabricated by injection molding a plastic material, such as polyethylene (PE), Polyethylene terephthalate (PET), Polyvinyl chloride (PVC), Acrylonitrile butadiene styrene (ABS), Polypropylene (PP), and Polystyrene (PS).

The members 100 and 110 are assembled together over the connector 10 as shown in FIGS. 7A, 7B to form cover assembly 120. The members are brought together as indicated by arrows 130, 132 (FIG. 7A). As the side wall portions 100B, 110C enter the cradle-like member 110, the wedge portions 104, 106 engage the side wall portions 110B, 110C, forcing the side wall portions 110B, 110C to flex apart, until the wedge portions fully enter the open regions 110B1, 110C1. The wedge portions then lock the two members 100, 110 together, in place about the connector 10. The depth dimension of the assembly 120 is such that the tips 14A of the ribs 14 on the connector engage against the back surfaces of the assembly 120, preventing the assembly from moving toward the back of the connector in response to forces from a mating connector in a misaligned orientation.

FIG. 8 shows how the cover assembly 120 allows the connectors 10, 20 to be mated together in the correct orientation, with key protrusion 16 entering open region 100D of member 100 and engaging key 16 of the connector 10. The side wall portions 110B, 110C and bottom 110A of cover assembly 120 define a frame structure about the periphery of the connector body, which mechanically blocks the connector 20 from engaging the connector 10 if the connector 20 is misaligned, as shown in FIG. 9.

Figure 12:
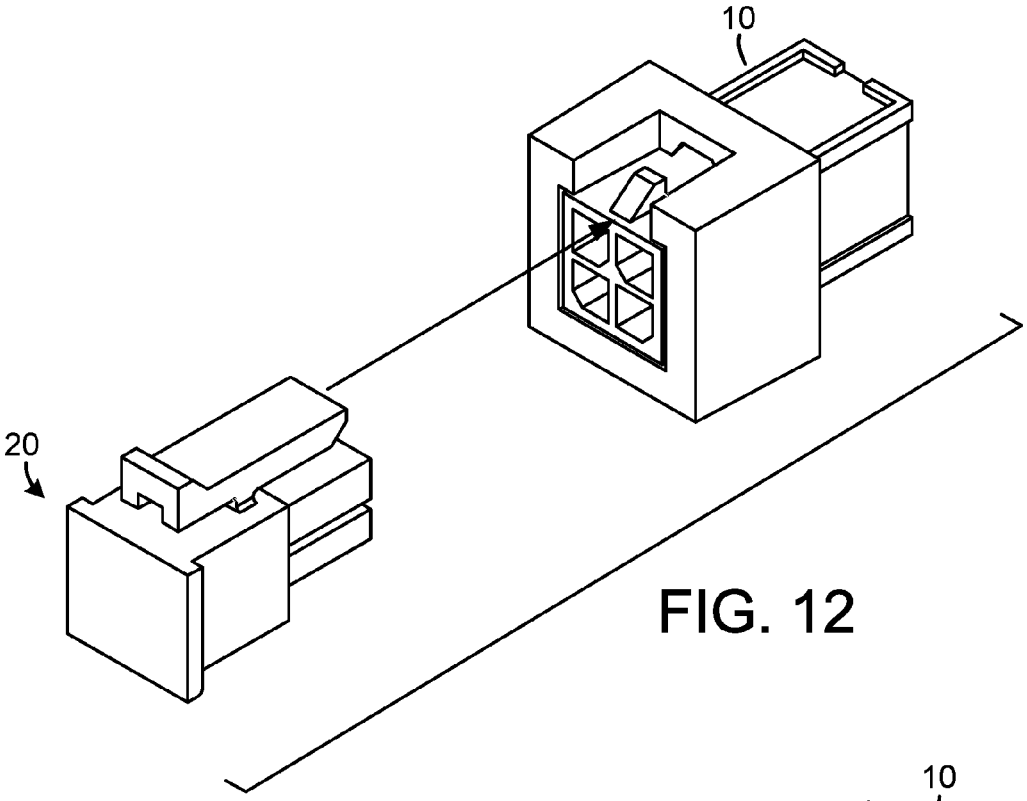
FIG. 12 illustrates the keyed connector with attached cover of FIG. 10A, and the mating connector in a position ready to be inserted to the keyed connector.
Figure 13:
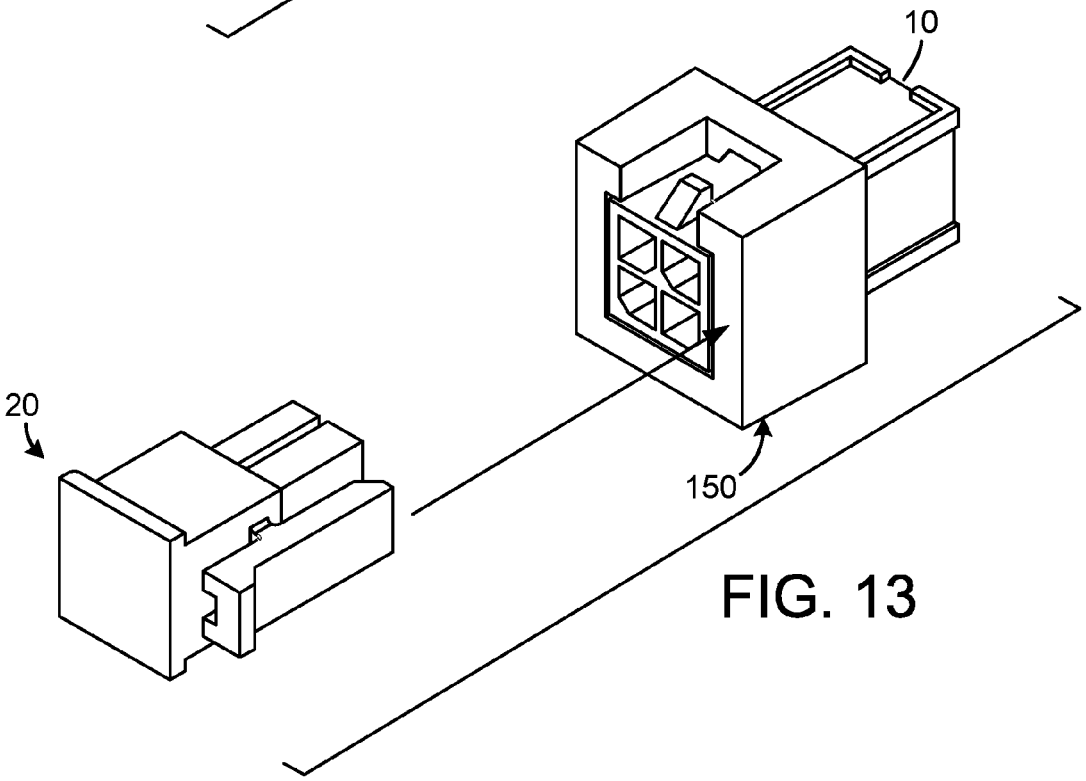
FIG. 13 is a view similar to FIG. 12, but with the mating connector oriented at a 90 degree angle relative to its position in FIG. 12, and illustrating that the cover will prevent connection of the connectors in a misaligned condition.

A further exemplary embodiment of a connector cover 150 is illustrated in FIGS. 10A-13. This embodiment is similar to the cover 50 (FIGS. 1A-4), except that the cover 150 does not include side arms or clips 54, 56. The cover 150 is slipped onto the connector 10 as illustrated in FIGS. 11A, 11B, until the rear surfaces of the cover contact the tips 14A of the ribs 14. The ribs prevent the cover from being pushed further back into a non-functional position. FIGS. 12 and 13 show that, with the cover 150 in position on the connector, the mating connector 20 only fits in the correct orientation. The cover blocks the connector 20 from being engaged with the connector 10 in any other orientation.

Although the foregoing has been a description and illustration of specific embodiments of the subject matter, various modifications and changes thereto can be made by persons skilled in the art without departing from the scope and spirit of the invention.

What is claimed is:

1. A cover for a keyed electrical connector including a connector body and a key protrusion from a surface of the body, the cover comprising:

a cover structure separate from the connector body and fabricated of an electrically non-conductive material, the cover structure defining an aperture, said cover structure configured to fit about and surround the connector body adjacent the mating end of the connector body with a portion of the connector body positioned within the aperture;

the cover structure defining a relieved area surrounding the key protrusions with the connector body so positioned, the relieved area configured to receive a corresponding key structure of a mating connector with the mating connector in a correct orientation relative to the connector, thereby not interfering with electrical connection of the connector and mating connector in the correct orientation;

the cover structure defining a frame about the connector body configured to present a mechanical block to the key structure of the mating connector with the mating connector in a misaligned orientation, preventing electrical connection of connector and mating connector in a misaligned orientation;

the cover structure further comprising a pair of opposed side arm clips extending from rear surfaces of the cover structure, and wherein the side arm clips are angled inwardly such that a distance between barb tips of the clips is slightly less than a width dimension of the connector body, the side arm clips sufficiently flexible to flex apart and slide over the connector body as the cover structure is positioned on the connector body;

the pair of side arm clips having a length sufficient to engage over back edges of the connector body to secure the cover in place on the connector.

2. The cover of claim 1, wherein the cover structure is configured to slide onto the connector body, with the connector body received within the aperture, until the cover structure abuts a stop surface on the connector body.

3. The cover of claim 1, wherein the cover structure is a unitary one-piece structure fabricated of a plastic material.

4. The cover of claim 1, wherein the cover structure is configured to slide onto the connector body to an installed position defined by interaction of a surface of the cover structure and a stop surface protruding from the connector body.

5. A cover for a keyed electrical connector including a connector body and a key protrusion from a surface of the body, the cover comprising:

a cover structure separate from the connector body and fabricated of an electrically non-conductive material, the cover structure defining an aperture, said cover structure configured to fit about and surround the connector body adjacent the mating end of the connector body with a portion of the connector body positioned within the aperture;

the cover structure defining a relieved area surrounding the key protrusions with the connector body so positioned, the relieved area configured to receive a corresponding key structure of a mating connector with the mating connector in a correct orientation relative to the connector, thereby not interfering with electrical connection of the connector and mating connector in the correct orientation;

the cover structure defining a frame about the connector body configured to present a mechanical block to the key structure of the mating connector with the mating connector in a misaligned orientation, preventing electrical connection of connector and mating connector in a misaligned orientation;

first and second members arranged to snap together to form the cover structure; and wherein:

the first member is a saddle-like structure having an inverted generally U-shaped configuration with an open area formed between opposed side wall portions and a top wall portion;

the second member is a cradle-like structure, including a bottom surface portion and side wall portions extending upwardly from the bottom surface portion;

the side wall portions of the first member configured to fit between the side wall portions of the second member, and further having wedge-shaped surfaces which engage surfaces of the side wall portions of the second member to lock the first and second members in place on the connector body.

6. An electrical connector system, comprising:

a first keyed electrical connector including a first connector body and a first key structure protruding from a surface of the first body:

a second keyed electrical connector including a second connector body and a second key structure protruding from a surface of the second body;

the first and second electrical connectors configured for electrical connection in a correct orientation of the first and second connector bodies, wherein the first and second key structures are engaged;

a cover comprising a cover structure separate from the first and second connector bodies and fabricated of an electrically non-conductive material, the cover structure defining an aperture, said cover structure configured to fit about and surround the first connector body adjacent a mating end of the connector body with a portion of the first connector body positioned within the aperture;

the cover structure defining a relieved area surrounding the first key structure with the first connector body positioned within the cover structure, the relieved area configured to receive the second key structure of second connector in the correct orientation, thereby not interfering with electrical connection of the first and second connectors in the correct orientation;

the cover structure configured to present a physical block to the second key structure of the second connector with the first and second connectors in a misaligned orientation, preventing electrical connection of the first connector and the second connector in a misaligned orientation.

7. The system of claim 6, wherein the cover structure further comprises:

a pair of opposed side arm clips extending from rear surfaces of the cover structure, and wherein the side arm clips are angled inwardly such that a distance between barb tips of the clips is slightly less than a width dimension of the first connector body, the side arm clips sufficiently flexible to flex apart and slide over the first connector body as the cover structure is positioned on the first connector body;

the pair of side arm clips having a length sufficient to engage over back edges of the first connector body to secure the cover in place on the connector.

8. The system of claim 7, wherein the cover structure is configured to slide onto the first connector body, with the first connector body received within the aperture, until the cover structure abuts a stop surface on the connector body.

9. The system of claim 7, wherein the cover structure is a unitary one-piece structure fabricated of a plastic material.

10. The system of claim 6, wherein the cover structure is configured to slide onto the first connector body to an installed position defined by interaction of a back surface of the cover body and a stop surface protruding from the first connector body.

11. The system of claim 6, wherein the cover structure is a unitary one-piece structure fabricated of a plastic material.

12. The system of claim 6, wherein the cover structure comprises:

first and second members, the first and second members arranged to snap together to form the cover structure.

13. The system of claim 12, wherein:

the first member is a saddle-like structure having an inverted generally U-shaped configuration with an open area formed between opposed side wall portions and a top wall portion;

the second member is a cradle-like structure, including a bottom surface portion and side wall portions extending upwardly from the bottom surface portion;

the side wall portions of the first member configured to fit between the side wall portions of the second member, and further having wedge-shaped surfaces which engage surfaces of the side wall portions of the second member to lock the first and second members in place on the first connector body.

14. The system of claim 6, wherein the first connector body has a generally square outer configuration.

* * * * *